United States Patent [19]

Kaslow

[11] 4,141,560

[45] Feb. 27, 1979

[54] BOARD GAME APPARATUS

[76] Inventor: Richard Kaslow, Box 165, Hill City, Minn. 55748

[21] Appl. No.: 721,357

[22] Filed: Sep. 8, 1976

[51] Int. Cl.[2] ..... A63F 3/00

[52] U.S. Cl. ..... 273/244; 273/277

[58] Field of Search ..... 273/131, 134, 137, 134 AG, 273/134 DB, 134 CB, 134 ES, 134 CA, 93 R, 244, 246, 277

[56] References Cited

U.S. PATENT DOCUMENTS

| | | | |
|---|---|---|---|
| 1,084,618 | 1/1914 | Elliott | 273/93 R |
| 1,113,504 | 10/1914 | Steele | 273/93 R |
| 2,610,060 | 9/1952 | Powell | 273/137 AB X |
| 3,428,317 | 2/1969 | Pulcifer | 273/93 R |
| 3,997,167 | 12/1976 | Kratzer | 273/134 CA |

FOREIGN PATENT DOCUMENTS

| | | | |
|---|---|---|---|
| 1814111 | 6/1970 | Fed. Rep. of Germany | 273/134 CA |
| 1275511 | 10/1961 | France | 273/134 CA |
| 367096 | 3/1963 | Switzerland | 273/134 CA |
| 764210 | 12/1956 | United Kingdom | 273/134 CA |
| 1384848 | 2/1975 | United Kingdom | 273/134 CA |

*Primary Examiner*—Anton O. Oechsle
*Assistant Examiner*—Harry G. Strappello
*Attorney, Agent, or Firm*—Peter Kent

[57] ABSTRACT

Game apparatus including a planar gameboard having indicia simulating a plurality of separate and unrelated sporting event courses such as a track for a bicycle race and track events, a boat rowing course, a swimming pool, an obstacle course, a baseball diamond, and a weightlifting match area. Gamepieces are moved along spaces on selected ones of the courses from a start to a finish line in accordance with the throw of a pair of dice and scores are determined on other ones of the courses by throwing the dice and consulting a chart on the gameboard associated with these courses. The number of dice throws to complete a selected course are converted to a time factor to determine a winner for these events, who is awarded a predetermined number of points. The high scorer on the other ones of the courses is the winner and is awarded points. Lesser finishers are also awarded points. These points are tallied on a scorecard to determine the overall winner of the game.

9 Claims, 7 Drawing Figures

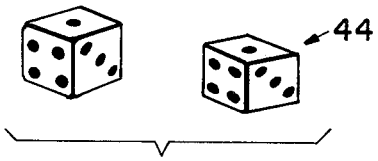
FIG. 3
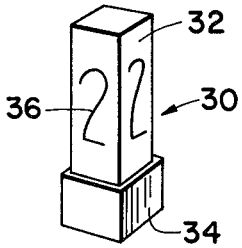
FIG. 2
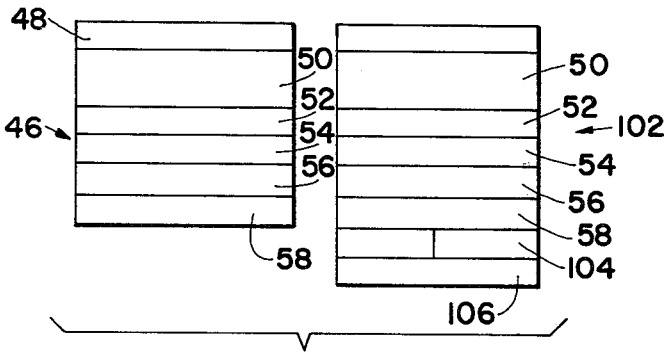
FIG. 4
96
| | |
|---|---|
| 2 | YES |
| 3 | YES |
| 4 | YES |
| 5 | YES |
| 6 | NO |
| 7 | NO |
| 8 | NO |
| 9 | YES |
| 10 | YES |
| 11 | YES |
| 12 | YES |
FIG. 5
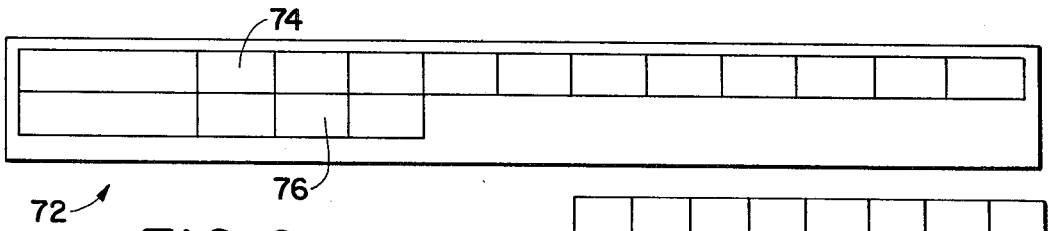
FIG. 6
FIG. 8
28
78
| | 150 | 155 | 165 | 175 |
|---|---|---|---|---|
| 2 | YES | YES | YES | YES |
| 3 | YES | YES | YES | YES |
| 4 | YES | YES | YES | YES |
| 5 | YES | YES | YES | NO |
| 6 | YES | NO | NO | NO |
| 7 | NO | NO | NO | NO |
| 8 | YES | NO | NO | NO |
| 9 | YES | YES | NO | NO |
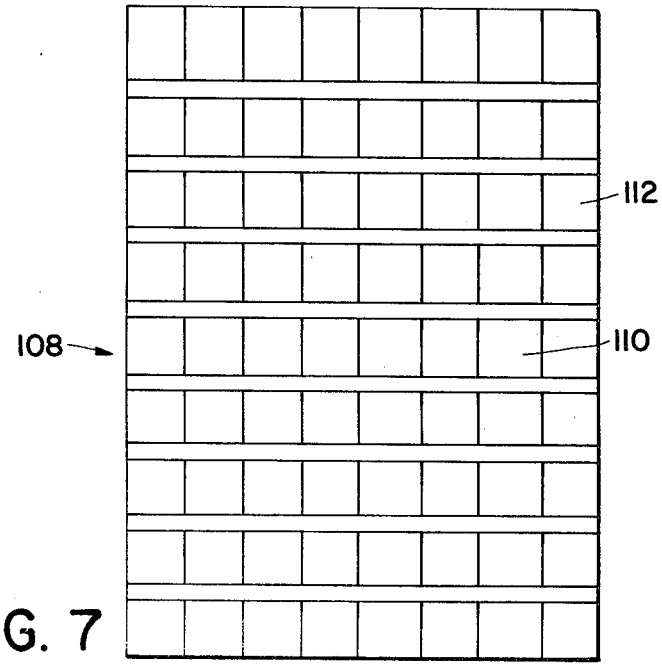
FIG. 7

BOARD GAME APPARATUS

BACKGROUND OF THE INVENTION

This invention relates to a game apparatus, and more particularly, a game apparatus for simulating a plurality of sporting events or contests.

The game apparatus of the present invention is directed to an entertainment and amusement device in which game pieces are moved about a plurality of courses by chance on a planar gameboard simulating the playing fields of a variety of sporting events. Participants accumulate point values depending on their order of finish in a particular event determined by the playing rules applicable to each course on the gameboard.

SUMMARY OF THE INVENTION

In particular, the gameboard of the invention includes simulated courses for eight different events including a bicycle race, a 100 yard dash, a ½ mile run, baseball hitting, weightlifting, boat rowing, 100 meter swimming, and an obstacle course. The participant obtaining the highest point total for the eight different events is the winner of the game. Gamepieces are positioned on a starting line on each course except in weightlifting and baseball hitting and are moved along rectangular spaces towards a finish line in accordance with the throw of a pair of dice or a die. The number of throws of the dice to reach the finish line on the course is equated to a time and compared to other participants. Point values are awarded in accordance with the placing of the participant in the particular event. In the weightlifting and baseball hitting events, dice thrown are correlated with charts on the gameboard to determine the order of finish of the participants, and point values are assigned to the participants. Various scorecards are provided for tallying the points scored by each player in each event, as well as a scorecard for accumulating the total score of each player for all eight events.

BRIEF DESCRIPTION OF THE DRAWING

Further objects and advantages of the invention will become apparent from the following description and claims, and from the accompanying drawings, wherein:

FIG. 2 is a perspective view of a gamepiece moved on the gameboard of FIG. 1;

FIG. 3 is a perspective view of a pair of dice used to move the gamepiece of FIG. 2 on the gameboard of FIG. 1;

FIG. 4 is a plan view of a pair of cards used to compute the time of a player in the boat rowing and obstacle course events on the gameboard of FIG. 1;

FIG. 5 is a plan view of a chart used in the obstacle course event;

FIG. 6 is a plan view of a score card used in the baseball hitting event on the gameboard of FIG. 1; and FIG. 7 is a plan view of a score card for use in determining the cumulative point total of each player.

FIG. 8 is an enlargement of a chart used in the weightlifting contest.

DETAILED DESCRIPTION OF THE PREFERRED EMBODIMENT

Figure 1:
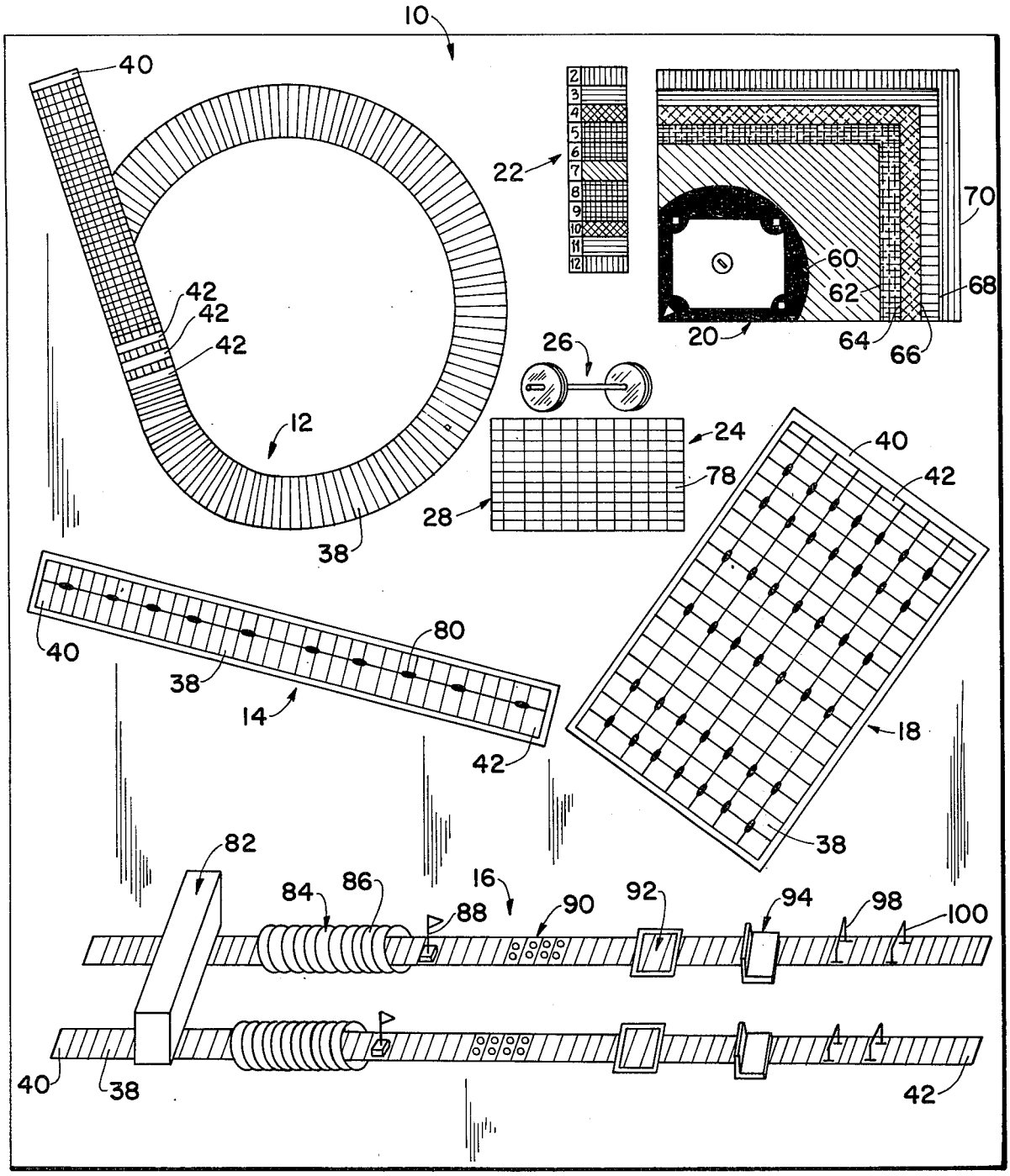
FIG. 1 is a top plan view of the gameboard of the game apparatus of the present invention.

Referring now to the drawings in detail, wherein like numerals indicate like elements throughout the several views, the game of the present invention includes a generally rectangular and planar gameboard 10 depicting a plurality of sporting event areas, such as a track 12 for conducting a bicycle race, a 100 yard dash, and a ½ mile run, a boat rowing course 14, an obstacle course 16, a swimming pool 18 for a 100 meter race, a baseball hitting range 20 and a chart 22 for use therewith, and a weightlifting area 24 including a bar bell 26 and a chart 28 used therewith. In all, eight separate events are played or contested on areas 12, 14, 16, 18, 20 and 24.

Two to eight players can compete in the various events depicted on gameboard 10. Eight gamepieces 30 each consisting of a block 32 mounted in a rectangular box 34 are provided to identify the players. Each block 32 is inscribed with a number indicum 36 identifying each player.

The areas 12, 14, 16 and 18 each comprise a course divided by indicia into rectangles 38 on which the gamepieces 30 are moved from a starting line 40 to a finish line 42 in accordance with the numbers on the upper faces of a pair of dice 44, as will be described hereinafter. The dice 44 are also used to determine information from the charts 22 and 28 in the baseball hitting and weightlifting areas.

The game is started with the bicycle race and the following events are then completed in order: 100 yard dash, ½ mile run, baseball hitting, weightlifting, boat rowing, 100 meter swim, and obstacle course. The different players decide between themselves the order in which they compete in each event.

Points are awarded for each event as follows: first place—10 points; second place—7 points; third place—5 points; fourth place—3 points; fifth place—1 point; sixth–eighth place—0 points. If five or more players compete, a second championship game can be played among the three players with the highest point total after the first game.

The bicycle race, the 100 yard dash, the ½ mile run, the boat rowing event, the 100 meter swim and the obstacle course are scored on a relative time basis in which a player completes the event course. This time is computed by multiplying by five seconds the number of throws of dice 44 it takes to complete the course. The number of rectangles over the finish line indicated by the last throw of dice 44 necessary to complete the course are subtracted from the total accumulated time in the event to determine the overall time for which points are awarded. The lowest time, as in the real event wins, the next lowest takes second place, and so on.

The rules to complete each event are as follows:

Bicycle Race

The bicycle race is conducted on the track course 12. Each player places his gamepiece 30 on starting line 40 of course 12 and throws the dice 44 to determine the number of moves or rectangles 38 the gamepiece 30 is moved. The gamepiece 30 must traverse the circular track 12 twice until the first finish line 42 is reached. Time is computed and points awarded as indicated heretofore. A time card, such as card 46 (FIG. 4), with a suitable indicia heading 48 indicating the event can be provided to each player to determine the player's time. For example, line 50 on card 46 can be inscribed with the number of dice throws, line 52 the number of seconds, line 54 the number of minutes and seconds, line 56 the number of extra squares on the last throw, and line 58 the overall net time.

100 Yard Dash

The 100 yard dash is also run on the track course 12. Each player places his gamepiece 30 on the starting line 40 of course 12 and the contest proceeds as in the bicycle race, except that the finish line is the intermediate finish line 42 on course 12, and the track course 12 is not lapped.

½ Mile Run

The ½ mile run is run on track course 12 with the same rules as the bicycle race and 100 yard dash, except that the last finish line 42 on track 12 is used and two laps around track course 12 are required.

Baseball Hitting

The baseball hitting event is conducted on baseball field 20, using chart 22 and dice 44. You are given three "outs" to accumulate as many points as possible. A single is scored as 1 point; a double as 2 points; a triple 3 points; and a home run as 4 points. The dice 44 are thrown to obtain a number. Next to the number on chart 22 is a color. Between arcuate line 60 and right angle 62, the color is green; between right angles 62 and 64 the color is yellow; between right angles 64 and 66 the color is orange; between right angles 66 and 68 the color is blue; and between right angles 68 and 70 the color is red. If dice 44 indicate the color is yellow this represents a single, and 1 point is scored; if the dice indicate orange, this represents a double and 2 points are scored; blue is a triple worth 3 points; and red is a homerun worth 4 points. Green is an "out," and after a player obtains three "outs," his turn at baseball hitting terminates.

A baseball hitting scorecard 72 is used by each player to keep track of his total points before terminating his turn. Scorecard 72 includes two rows of boxes 74 and 76. Boxes 74 are used to record any points obtained by throw of dice 44, and boxes 76, the "outs." The last of the boxes 74 is used to total the points obtained. The highest total of any player is awarded first place points; the second highest, second place; and so on.

Weightlifting

The weightlifting event is conducted with dice 44 and chart 28. The dice 44 are thrown to obtain a number. Next to each number on chart 28 is a horizontal row of 10 boxes 78 representing a weightlifting classification, e.g., 150, 155, 165, 175, 180, 185, 190, 200, 210, and 220 lbs. Starting with the lowest weight classification, a player locates the box 78 next to the number thrown on dice 44. The box will contain either the designation "YES" or "NO." If the box states "YES," the player proceeds to the next weight classification and tosses dice 44 again. If the box states "NO," the player has missed lifting the weight and is eliminated from further competition in the event. The players containue until one player is left, who is declared the winner of the event and awarded the highest points. The next to last player eliminated is awarded second place, and so on.

Boat Rowing

Boat rowing is conducted on course 14 provided with two rows of squares 38, simulating rowing lanes separated by pontoons 80. The players are paired off in two's and traverse course 14 in the same manner as the bicycle race, 100 yard dash, and ½ mile run from starting line 40 to finish line 42.

100 Meter Swim

The swimming pool 18 is used to conduct this event. Each player places a gamepiece 30 on a starting line 40 and moves the gamepiece in rectangles in each lane until the gamepiece has returned to a finish rectangle 42. Times and scoring are the same as in the bicycle race, 100 yard dash, ½ mile run, and boat rowing events.

Obstacle Course

The obstacle race is run on the obstacle course 16 which has two tracks. Players are paired off in two's and each places a gamepiece 30 on a starting rectangle 40 on each track. Moves are determined by throwing both dice 44.

The first obstacle is the rope climb represented by a rectangular box or wall 82. If a player lands on a rectangle 38 within wall 82 he returns to the rectangle in front of the wall 82 and throws the dice again until the wall is passed.

The second obstacle is the tunnel 84. If a player lands on one of the circles 86 of the tunnel 84, he must use only one die until he is out of the tunnel, thereby accumulating throws, which are the equivalent of lost time.

The third obstacle is the blocking dummy 88. If a player lands on one of the rectangles 38 before or after the dummy 88 during his turn of throwing two dice, a five second penalty is added to his score.

The fourth obstacle are the tires 90 positioned in four of the rectangles 38. If a gamepiece 30 is positioned in one of the rectangles, a five second penalty is added to the score.

Similarly, the fifth obstacle is a water hazard 92. If a player lands his gamepiece on a rectangle 38 in water hazard 92, a five second penalty is added to the total time. The player then moves his gamepiece 30 to the rectangle immediately after hazard 92.

The sixth obstacle on track course 16 is the high jump 94. Once the rectangle 38 on course 16 depicting high jump 94 is crossed with a gamepiece 30, a chart 96 is consulted to see if the high jump bar was knocked over or not. The dice 44 are thrown and the "YES" or "NO" next to the number on the chart 96 corresponding to the number shown by the dice 44 answers the question. If the answer is "YES," a five second penalty is added to the total time for the course 16.

The seventh and last obstacle on course 16 are two hurdles 98 and 100. As each of the hurdles are passed, chart 96 is again consulted to see if a penalty is incurred from knocking over one or both of the hurdles 98 and 100. If the answer on chart 96 if "YES," a five second penalty is assessed.

A special scorecard 102 is provided to each player to keep score as the obstacle course 16 is traversed. As with card 46, lines 50, 52, 54, 56 and 58 are provided to keep track of the number of throws, the equivalent time in seconds, the number of minutes and seconds, the deduction for extra squares on the last throw of the dice 44, and the adjusted total time. In addition a split line 104 is used to keep track of penalty points. A mark is placed in the left hand portion of line 104 every time a penalty is obtained. The number of marks are multiplied by 5 and the number entered in the right hand portion of line 104. This number is added to the adjusted time on line 58 and entered in line 106 as the total elapsed time to be compared with other contestants when awarding points.

A tabulation scorecard 108 summarizing the points awarded each player in each event is also provided. Scorecard 108 includes columns 110 for entering the individual points for each player in rows 112 under each event. If desired, a total row may be provided to add the individual points awarded each player in each event so a winner can be determined.

In the event of a tie in any of the eight events, the players tied each throw the dice three times and the highest total is declared first place winner. The principle is identical for second place, third place ties and so forth. The loser of the throw-off and all other players drop down by one position.

I claim:

1. Game apparatus comprising:

a plurality of gamepieces;

a pair of dice;

a planar gameboard including indicia simulating a plurality of areas for the conduct of separate and unrelated sporting events;

at least one of said areas on said gameboard being divided by indicia into a course having substantially rectangular spaces for receiving thereon said gamepieces for movement along said spaces from a starting line to a finish line in accordance with the dice reading appearing on a throw;

another of said areas including a substantially rectangular area simulating a baseball diamond, said diamond having an arcuate line and colored bands around said arcuate line; and a chart on said gameboard having a column of possible dice readings, each reading having associated therewith a color present on said diamond, so that a player upon throwing the dice may determine the points awarded.

2. The game apparatus of claim 1 wherein said course has a substantially circular track for conducting a bicycle race, a 100 yard dash, and a ½ mile run.

3. The game apparatus of claim 1 wherein said course has a pair of substantially parallel, rectangular tracks each simulating an obstacle course having a variety of obstacles depicted thereon.

4. The game apparatus of claim 3 including a chart for determining whether a penalty is to be assessed to a player as his gamepiece attains an obstacle depicted on said course, said penalty being dependent on the number shown by the dice on the throw on which said gamepiece attains said obstacle.

5. The game apparatus of claim 1 wherein said course is a substantially rectangular course simulating a swimming pool.

6. The game apparatus of claim 1 wherein said course is a substantially rectangular course simulating a boat rowing course.

7. The game apparatus of claim 1 wherein a scorecard is provided for computing the time in which a gamepiece traverses said course, a scorecard is provided for computing the score accumulated on said areas, and a scorecard is provided for tallying the accumulated points awarded to each participant for each event.

8. The game apparatus of claim 1 wherein each of said gamepieces includes a hollow stand, and a block containing number indicia inserted within said stand.

9. Game apparatus comprising:

a plurality of gamepieces;

a pair of dice a planar gameboard including indicia simulating a plurality of areas for the conduct of separate and unrelated sporting events;

at least one of said areas on said gameboard being divided by indicia into a course having substantially rectangular spaces for receiving thereon said gamepieces for movement along said spaces from a starting line to a finish line in accordance with the dice reading appearing on a throw;

another of said areas including indicia for simulating a weight lifting match; and a chart on said gameboard having a column of possible dice readings, each reading having associated therewith a row of entries, the entries representing an increasing succession of weights, each entry being yes or no.

* * * * *